US006949737B2

(12) United States Patent
Schwieters et al.

(10) Patent No.: US 6,949,737 B2
(45) Date of Patent: Sep. 27, 2005

(54) DEVICE FOR COLLECTING IONS IN A MASS SPECTROMETER

(75) Inventors: Johannes Schwieters, Bremen (DE); Ronald Seedorf, Weyhe (DE)

(73) Assignee: Thermo Electron (Bremen) GmbH, Bremen (DE)

( * ) Notice: Subject to any disclaimer, the term of this patent is extended or adjusted under 35 U.S.C. 154(b) by 66 days.

(21) Appl. No.: 10/618,285

(22) Filed: Jul. 11, 2003

(65) Prior Publication Data

US 2004/0089801 A1 May 13, 2004

(30) Foreign Application Priority Data

Aug. 16, 2002 (DE) ..... 102 38 347

(51) Int. Cl.[7] ..... H01J 49/00
(52) U.S. Cl. ..... 250/283; 250/292; 250/281; 250/282
(58) Field of Search ..... 250/283, 292, 250/281, 282; 313/103 R, 104, 105, 95

(56) References Cited

U.S. PATENT DOCUMENTS 4,987,335 A 1/1991 Yamamoto et al.
5,689,152 A * 11/1997 Boutot et al. ..... 313/532
6,091,068 A * 7/2000 Parfitt et al. ..... 250/292
6,180,942 B1 * 1/2001 Tracy et al. ..... 250/299

FOREIGN PATENT DOCUMENTS

EP 0278034 A1 5/1988
EP 0932184 A1 7/1999

* cited by examiner

*Primary Examiner*—John R. Lee
*Assistant Examiner*—Zia R. Hashmi
(74) *Attorney, Agent, or Firm*—Dorsey & Whitney LLP

(57) ABSTRACT

The invention relates to a device for collecting ions, in particular in an isotope mass spectrometer. At least one secondary electron multiplier (SEM) is provided, this being constructed in the manner of a card, namely box-like and with a thickness which is low in comparison with its length and width. The SEM is held in a frame. In addition, a flat flexible printed circuit board with a plurality of parallel conductors is connected to the SEM. The flexible printed circuit board permits the positioning of the SEM in order to match the ion paths to be sampled.

8 Claims, 6 Drawing Sheets

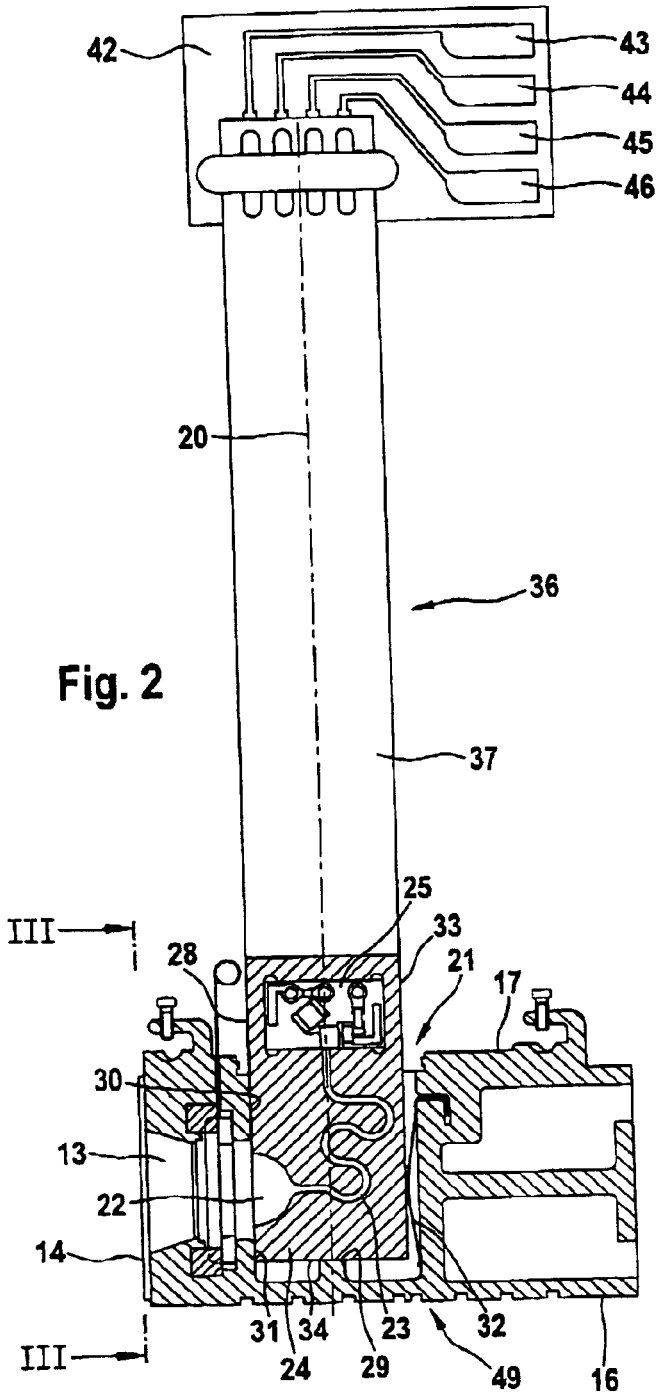
Fig. 2
Fig. 3
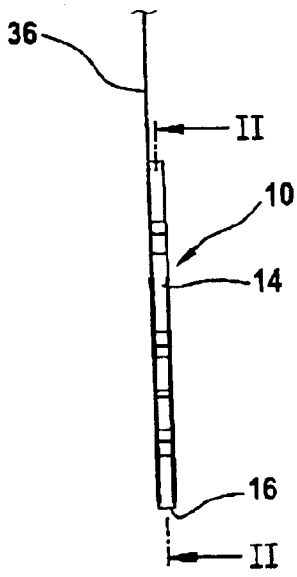

DEVICE FOR COLLECTING IONS IN A MASS SPECTROMETER

RELATED APPLICATIONS

This application claims priority to German Patent Application Serial No. 102 38 347.2, filed on Aug. 16, 2002, the disclosure of which is hereby incorporated by reference in its entirety.

BRIEF DESCRIPTION OF THE INVENTION

The invention relates to a device for collecting ions, in particular in a mass spectrometer, having at least one secondary electron multiplier (SEM), the SEM being formed in the manner of a card, specifically substantially box-like with a low thickness in relation to the length and width.

BACKGROUND OF THE INVENTION

In a brochure entitled "Triton Neptune, Multicollector Mass Spectrometers for High Precision Isotope Ratio Determination" published by Thermo Finnigan MAT GmbH, Bremen, Germany, 2001, various constituent parts of mass spectrometers are explained. Inter alia, a multicollector as an ion collector having a large number of Faraday cups is illustrated. The Faraday cups are of rectangular and flat disc-like design, so that a plurality of Faraday cups can be arranged beside one another at short intervals in the ion path. For measurements of only low ion currents, in particular in connection with isotope ratio determination, SEM are preferably needed. These must be matched as well as possible to the existing system.

SEM having approximately the size and the dimensions of a cheque card are known. The SEM are somewhat smaller than the Faraday cups.

OBJECTS AND SUMMARY OF THE INVENTION

It is an object of the present invention to provide a device for collecting ions in a mass spectrometer, which can be used and adapted as flexibly as possible. The device according to the invention is characterized in that the SEM is held in a frame. The frame can have approximately the dimensions of the Faraday cup, which would be otherwise used. The SEM is insertable and removable from the frame. Accordingly, the frame is preferably somewhat thicker than the SEM. As a result of using the frame, the external dimensions of the SEM are matched to the dimensions of other constituent parts of the device. At the same time, the frame permits easy replacement of the SEM. In this way, the SEM can be held in the frame merely by being wedged in.

In one embodiment of the invention, provision is made for the SEM to have an entry opening for the ions on a narrow side, for the frame to have a passage opening for the ions on a narrow end side, the inlet opening and the passage opening being aligned with each other, and for the SEM to be at least partially inserted into the frame on a further narrow side of the latter which is located transversely with respect to the narrow end side. The frame is upright with large-area, upright walls. The SEM is inserted into the frame from above. The passage opening of the frame is located at its front end side, while the large-area upright walls of the frame are aligned substantially parallel to the ion flight path. The greatest length of the frame likewise extends parallel to the ion flight path. By contrast, the greatest dimension of the SEM extends parallel to the insertion direction (insertion of the SEM into the frame).

Preferably, and independently of the inventive features mentioned previously, a flat flexible printed circuit board having a plurality of parallel lines is connected to the SEM. The flexible printed circuit board is also referred to as a strip conductor or flexible conductor track. Similar flexible conductor tracks are used in ink jet printers for the electrical drive of the print head. In the present case, the flexible printed circuit board initially extends in the plane of the SEM. In this plane, the individual lines including signal lines are located beside one another and parallel to one another at intervals. An end of the flexible printed circuit board opposite to the SEM is connected to electrical contacts, which lead onward. By means of the use of the flexible printed circuit board in the manner described, the space available for the electrical connections is optimally utilized. The influence on the signals resulting from high voltages, which are naturally present is minimized. If a plurality of SEM are arranged beside one another, nevertheless far-reaching possible adjustments for the individual SEM are provided for matching to the ion paths to be sampled. The flexible printed circuit boards are also preferably insulated electrically on only one side, for cost reasons, namely by the base material. Applied to the latter are individual conductor tracks, preferably without additional insulation. Adjacent flexible printed circuit boards cannot short-circuit one another since there is always an insulated side opposite a side provided with electrical conductors. Electric lines of adjacent SEM never come to lie opposite one another.

One channel input of the SEM is preferably earthed. Accordingly, the channel output is connected to high voltage, in particular to about 2000 V.

The frame can preferably be connected to a holder by its narrow underside. The frame is held in a defined position by the holder or can be inserted into the holder in a defined position. The holder itself can be adjusted transversely with respect to the ion flight path, so that the frame can be set to a defined ion flight path.

The frame preferably has holding means on its narrow upper side to connect the frame to a guide means. This results in further possible adjustment in interplay between the holding means and the guide means (or a plurality of guide means).

According to a further embodiment of the invention, a plurality of SEM are provided with frames, the frames being held on at least one common guide means and being capable of being positioned relative to one another at defined intervals on the latter. Accordingly, the guide means permit a plurality of frames to be combined into a group, it being possible for defined positions to be assumed within the group. At least one frame of the group is preferably provided with a holder, so that the result is that a group with a plurality of SEM (in corresponding frames) is held only by one frame. The guide means provided are preferably two rods, onto which the individual frames are threaded with appropriate holding means.

In addition, at least one Faraday cup is preferably provided, whose external dimensions correspond to those of the frame. The Faraday cup is a specific ion collector, which can be provided in addition to the SEM.

According to a further embodiment of the invention, groups are formed which contain either at least one Faraday cup and otherwise at least one SEM, or which contain more than one SEM, at least one Faraday cup or SEM in a group being connected to a holder by its narrow underside, and the Faraday cups and SEM within the same group being arranged on one or more common guide means via holding means on the upper side and being capable of being positioned relative to one another. Accordingly, by adjusting one holder, an entire group can be displaced, in particular transversely with respect to the running direction of the ion beam. Adjustments of the positions within a group are carried out by moving the holding means along the guide means.

A mass spectrometer is also a constituent part of the invention, in particular an isotope mass spectrometer, having one or more devices according to the invention, preferably having a multicollector.

BRIEF DESCRIPTION OF THE DRAWINGS

Further features of the invention emerge from the claims and otherwise from the description. Advantageous embodiments of the invention wall be explained in more detail below in connection with the drawings, in which:

FIG. 2 shows an illustration similar to FIG. 1, but cut open and with a flexible printed circuit board connected to the SEM;

FIG. 3 shows the view taken along the line III—III of FIG. 2 showing one end of the frame with inserted SEM;

DESCRIPTION OF PREFERRED EMBODIMENTS

Figure 1:
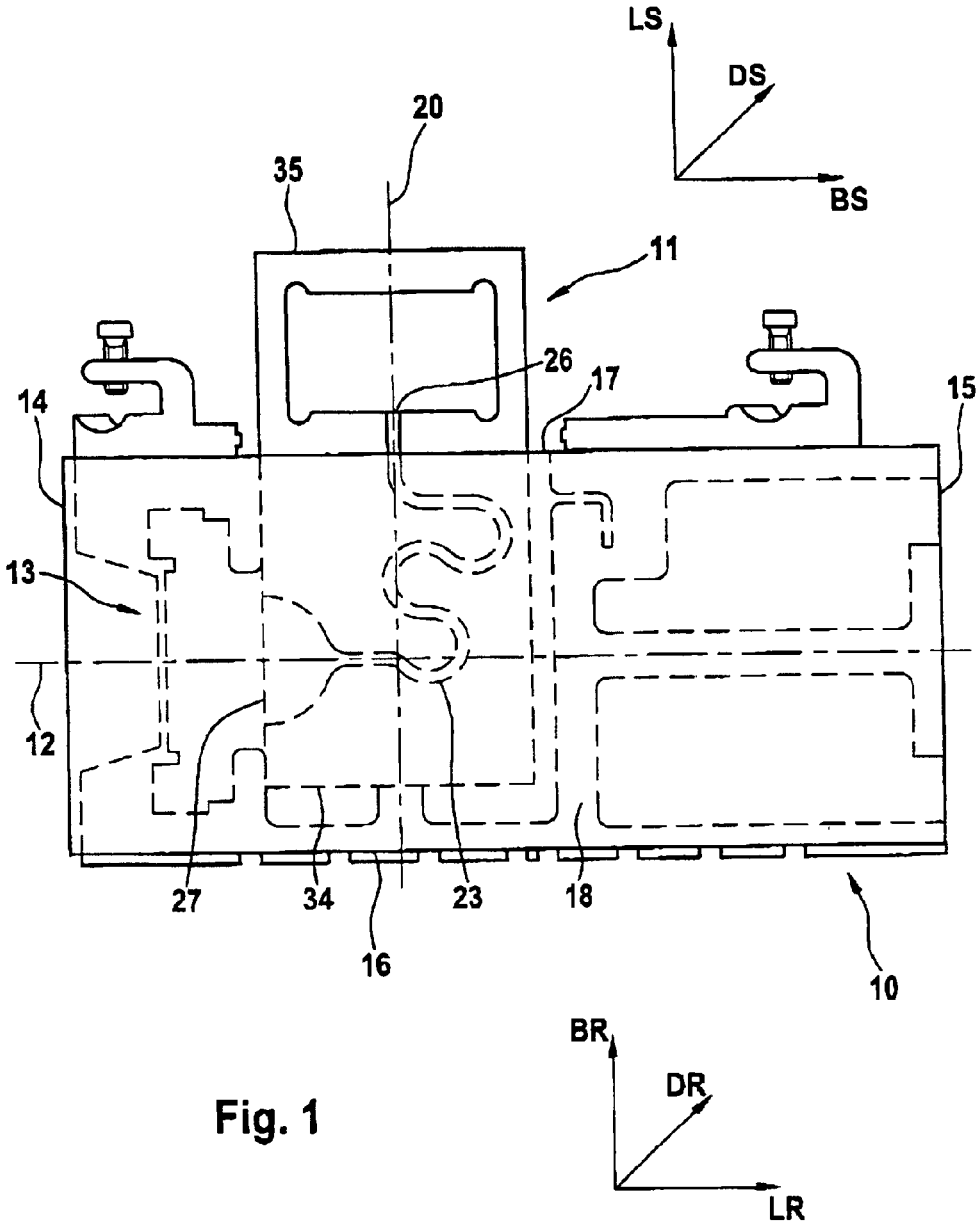
FIG. 1 shows a secondary electron multiplier (SEM) inserted into a frame, in side view.

FIG. 1 shows a secondary electron multiplier (SEM) 11 inserted into a frame 10. The frame is of substantially rectangular design with a length LR in the direction of a longitudinal mid-axis 12 and a width BR extending transversely with respect thereto. The frame 10 has a thickness DR which is very low as compared with the width BR or length LR and which is oriented at right angles to the plane of the figure. Corresponding directional indicators for the aforementioned dimensions comprising length LR, width BR and thickness DR are likewise shown in FIG. 1. Overall, the dimensions of the frame are comparable with those of a somewhat thicker cheque card.

Figure 6:
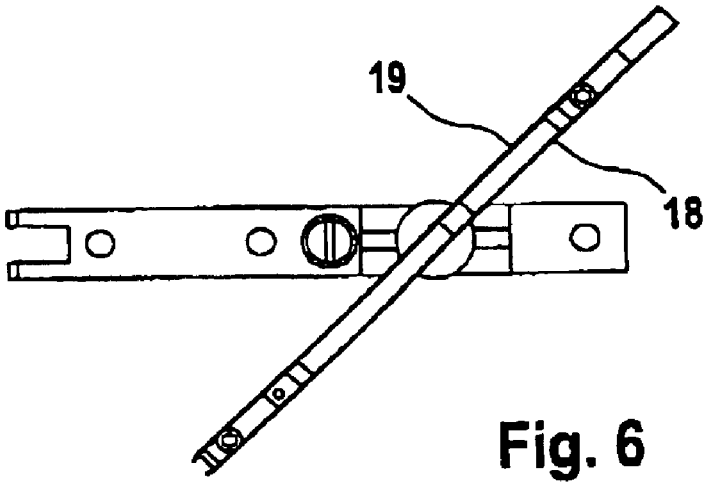
FIG. 6 shows a plan view of the frame with holder according to FIG. 5.

The frame 10 has a narrow end side 14 provided with a passage opening 13, a narrow end side 15 opposite the former, a narrow underside 16, a narrow upper side 17 and large-area side walls 18, 19 lying parallel to the plane of the figure, see also FIG. 6. The designations upper side and underside also relate to the envisaged arrangement of the frame 10 in an isotope mass spectrometer.

The SEM 11 likewise has a format similar to a cheque card, namely with a length LS along a longitudinal mid-axis 20, a width BS and a thickness DS. The latter extends at right angles to the plane of the figure. The longitudinal mid-axis 20 runs in the plane of the figure but at right angles to the longitudinal mid-axis 12 of the frame 10. The thickness DS is somewhat smaller than the thickness DR of the frame 10.

The SEM 11 is plugged into the frame 10 from above, that is to say, in the area of the narrow upper side 17. A corresponding receiving opening in the frame 10 is designated by the number 21. The SEM 11 inserts into the frame 10 over about ⅔ of its length and has a bell-like inlet opening 22, a meandering channel 23 which adjoins the said inlet opening 22, an insulating ceramic body 24 and electrical terminals 25. The construction of such an SEM of cheque-card size with a continuous dynode is known in principle. The ions entering the inlet opening 22, each time they collide with walls of the channel 23, knock out secondary electrons which, in turn, separate further secondary electrons during the collision. There is an amplification of about $10^7$ at a channel output 26 here. In the present case, a high voltage of about 2000 V is applied to the channel output 26, while a channel input 27 is earthed. The inlet opening 22 of the SEM 11 is aligned with the passage opening 13 of the frame 10 and is arranged on a narrow long side 28 of the SEM 11.

The receiving opening 21 in the frame 10 is provided on the inside with a lower supporting surface 29 and two lateral supporting surfaces 30, 31 and a compression spring 32. The compression spring 32 acts on a further narrow long side 33 of the SEM 11, opposite the narrow long side 28. A narrow lower end side 34 of the SEM 11 comes to lie on the lower supporting surface 29, which is considerably smaller for this purpose. The narrow long side 28 rests on the lateral supporting surfaces 30, 31, above and below the inlet opening 22. Overall, the SEM 11 is positioned as accurately as possible after being inserted into the frame 10.

Figure 4:
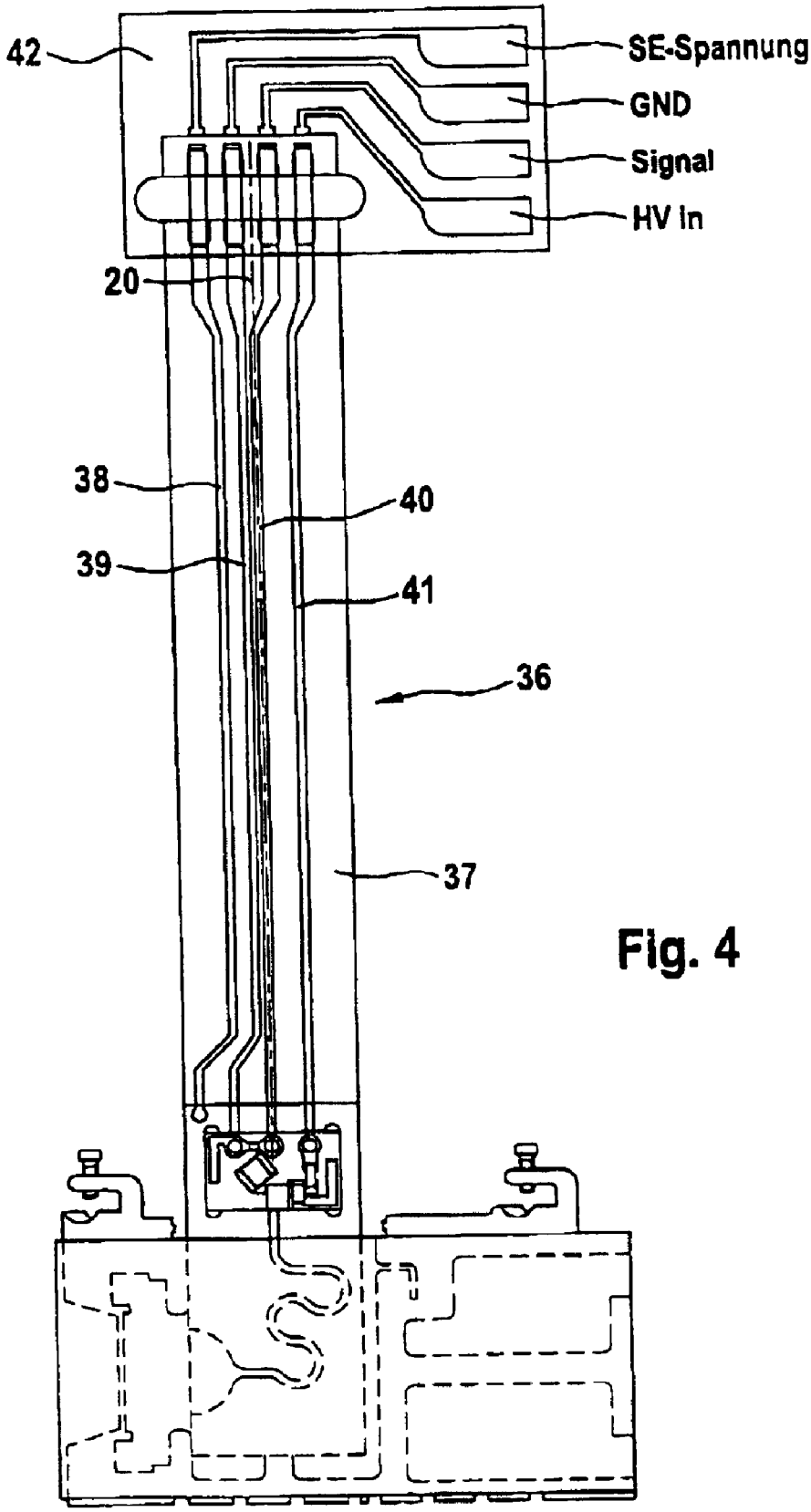
FIG. 4 shows an illustration corresponding to FIG. 1, but with a flexible printed circuit board on the SEM.

Opposite the lower end side 34, the SEM has an upper narrow end side 35. In the area of the same, a flexible printed circuit board 36 is connected to the SEM 11. On the flexible printed circuit board 36, four lines are printed beside one another on a carrier 37 made of flexible plastic, or applied in another way, see FIG. 4. The individual conductors 38, 39, 40, 41 are provided for different voltages. The outer conductor 38 carries the secondary electron voltage. The conductor 39 lying closest thereto is earthed. The following conductor 40 carries the ion signal. The last, outer conductor 41 is connected to a high voltage.

At an end opposite the SEM 11, the flexible printed circuit board 36 has a connecting piece 42 having four contacts 43, 44, 45, 46, which are associated with the conductors 38, 39, 40, 41.

Figure 5:
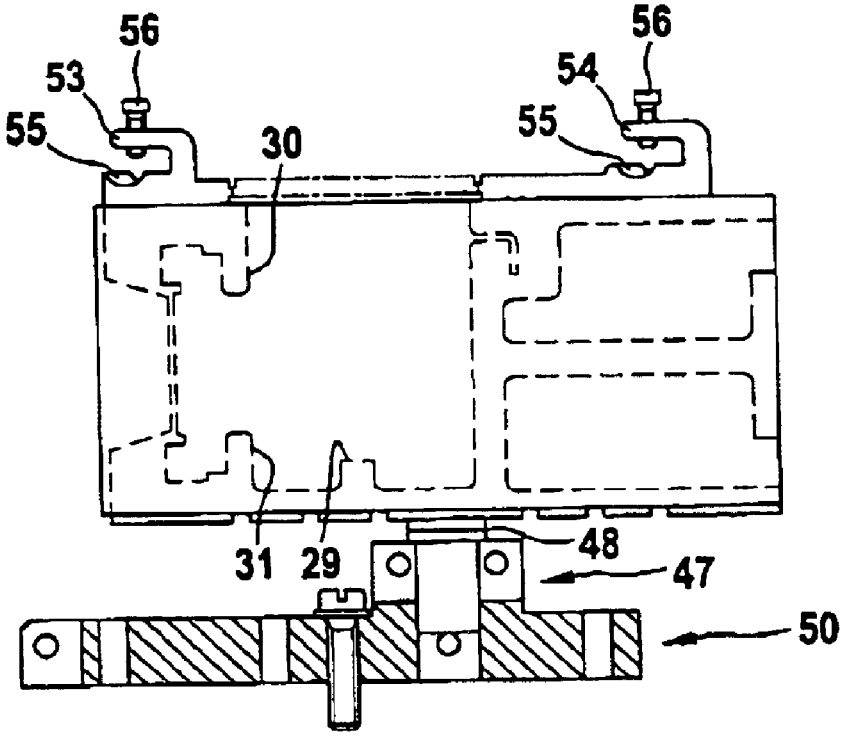
FIG. 5 shows an illustration of the frame corresponding to FIG. 1 (without SEM) and on a holder on the underside.

The SEM 11 with frame 10 is a constituent part of a multicollector, not specifically shown, for a mass spectrometer. In order to record an ion distribution (or for other reasons), a plurality of frames 10 with SEM 11 are provided beside one another. In this case, various types of groups can be formed. Firstly, the frames 10 with SEM 11 can be arranged with their undersides 16 on specific holders 47. FIG. 5 shows a frame 10 on a holder 47. The latter has a cylindrical receptacle 48 for the frame 10. The receptacle 48 is provided, in a manner not specifically shown, with a specifically configured upper side, so that recesses 49 on the underside 16 can be placed on the holder 17 in an exactly reproducible position.

The holder 47 is arranged on a carriage 50 which, in a manner not shown specifically, can be displaced with a movement component transverse to the ion beam. Given a plurality of carriages 50 each having a frame 10, the individual SEM can be positioned independently of one another. An arrangement having a plurality of carriages (but with Faraday cups) is shown in more detail in the company brochure from Thermo Finnigan MAT GmbH cited in the introduction to the description. Reference is made to the entire disclosure of the company brochure.

Figure 7:
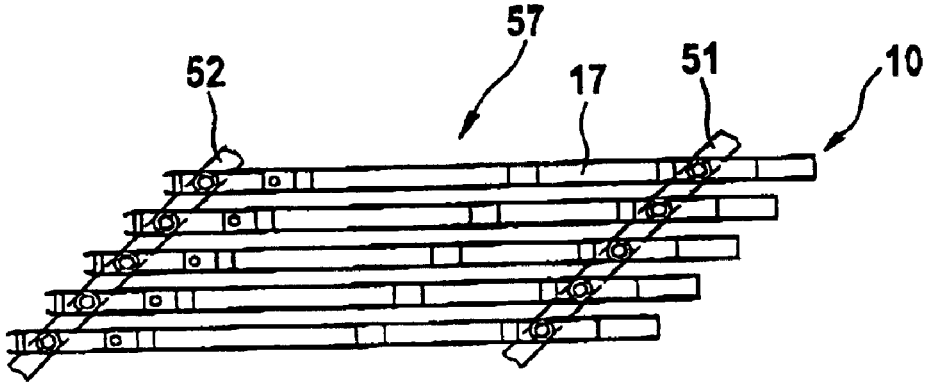
FIG. 7 shows a plan view of a plurality of frames threaded onto guide means.

FIG. 7 shows a plurality of frames 10 arranged with their large-area side walls 18, 19 adjacent. The said frames are threaded onto two guide means 51, 52 constructed as rods. For this purpose, each frame 10 has holding means 53, 54 on its narrow upper side 17. In practical terms, these are hooks with inner contact surfaces 55 and locking screws 56 opposite the latter. By means of the aforementioned guide means 51, 52 and holding means 53, 54, it is possible to connect a plurality of frames 10 to one another to form a group 57 and, at the same time, to define the relative arrangement of the frames 10 within the group 57 exactly. One of the frames 10 is mounted on the holder 41 shown in FIGS. 5 and 6 and can be adjusted with the carriage 50. Accordingly, the entire group 57 can be moved with the carriage 50. Mobility is also favoured by the aforementioned flexible printed circuit boards 36 on each frame 10.

Instead of the frame 10 with SEM 11, the Faraday cups shown in the aforementioned company brochure can also be arranged on the carriage 50 or holders 47. Their construction can be seen in the company brochure and, in addition, is illustrated in the German Laid-Open Specification DE 198 38 553. In the present case, holding means corresponding to the holding means 53, 54 illustrated in FIG. 5 are additionally provided.

Figure 8:
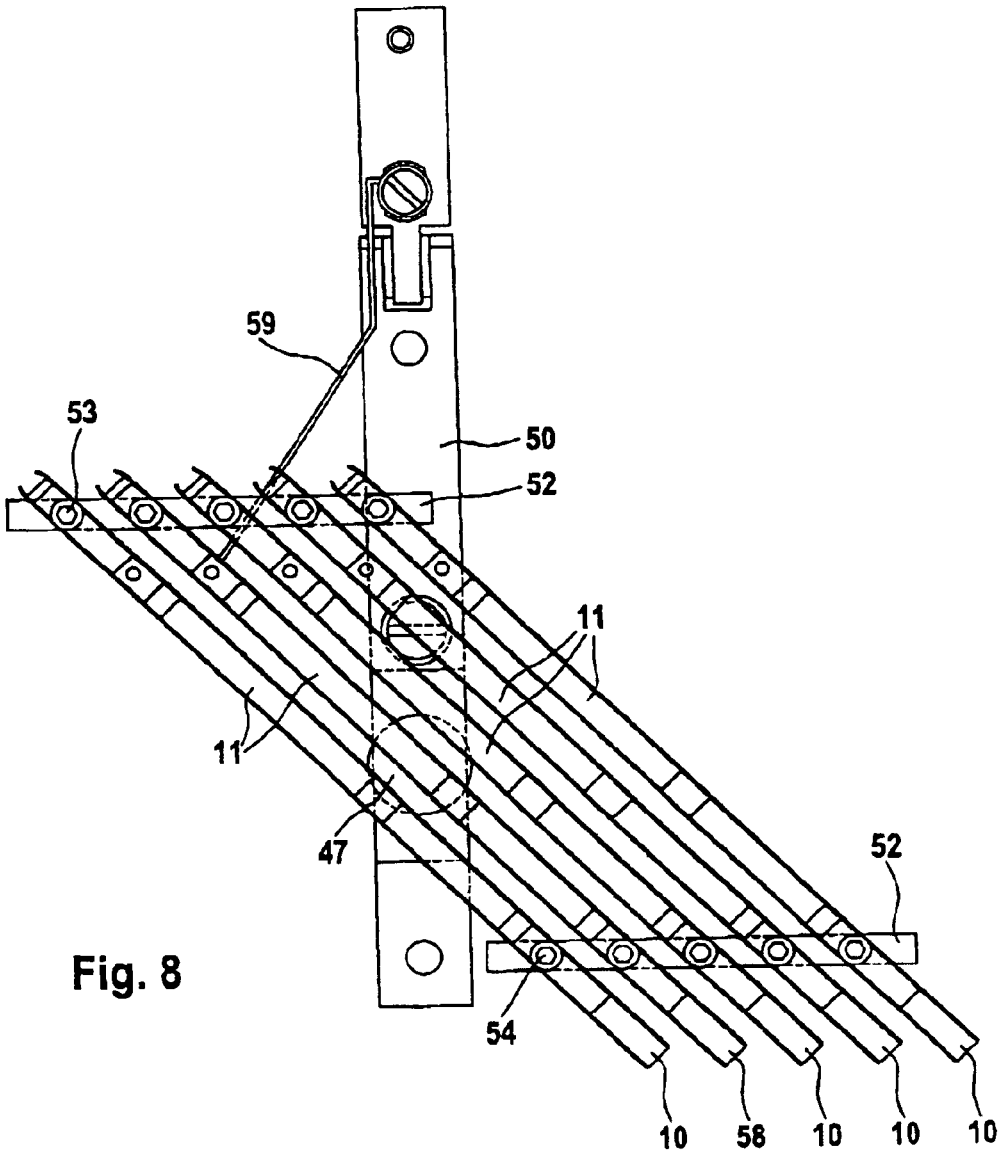
FIG. 8 shows a plan view of a group of SEM with Faraday cup on a holder.

The external dimensions of the frames 10 and of the Faraday cups should largely correspond to one another. This makes it possible to form groups which contain only frames 10 with SEM 11 or else at least one Faraday cup and at least one frame 10 with SEM 11, the individual members of a group being held together by the guide means and holding means already mentioned. A group 57 with a Faraday cup 58 and four frames 10 is shown in plan view in FIG. 8, in a similar way to FIG. 6. The Faraday cup 58 is connected electrically by a conductor 59 to the carriage 50 but not to the SEM 11. In addition, only the Faraday cup 58 is situated on the holder 47. Otherwise, the group is held together by the holding means and guide means 51, 52. Finally, the Faraday cups can also have flexible printed circuit boards for an electrical connection.

What is claimed is:

1. A device for collecting ions, in particular in a mass spectrometer, having at least one secondary electron multiplier (SEM) formed in the manner of a thin box-like card with four sides and a channel characterized in that the SEM channel has an ion inlet opening on one side and is adapted to be held in a thin frame having an opening for receiving ions whereby when the SEM is inserted in the frame, the ion inlet opening coincides with the frame opening for receiving ions.

2. A device according to claim 1 characterized in that a flat flexible printed circuit board having a plurality of parallel conductors is connected to the SEM.

3. A device according to claim 1 in which a channel is connected to the inlet opening and the channel input of the SEM is earthed.

4. A device according to claim 1 or 3 further characterized in that the frame is adapted to be connected to a holder at its narrow underside.

5. A device according to claim 4 characterized in that the frame has holding means to connect the frame to at least one guide means.

6. A device according to claim 1 or 4 characterized in that a plurality of SEMs are provided with frames, the frames being held on at least one common guide means and being capable of being positioned relative to one another at defined intervals on the common guide means.

7. A device according to claim 6 characterized in that, in addition, at least one Faraday cup whose external dimensions correspond to those of the frame is held on the guide means.

8. A device according to claim 6 characterized in that groups of frames are provided which contain either at least one Faraday cup and otherwise at least one SEM or which contain more than one SEM at least one Faraday cup or SEMs in a group connected to a holder by their narrow underside and the Faraday cups and SEM within the same groups are arranged on one or more common guide means via holding means and capable of being positioned relative to one another.

* * * * *